US005276658A

United States Patent [19]

Bullat et al.

[11] Patent Number: 5,276,658

[45] Date of Patent: Jan. 4, 1994

[54] ACOUSTIC WINDOW

[75] Inventors: David M. Bullat, Carlsbad; Philip C. Bradshaw; Jay C. Brown, both of San Diego, all of Calif.

[73] Assignee: The United States of America as represented by the Secretary of the Navy, Washington, D.C.

[21] Appl. No.: 987,497

[22] Filed: Nov. 19, 1992

[51] Int. Cl.[5] ..... H04R 1/00

[52] U.S. Cl. ..... 367/174; 367/173

[58] Field of Search ..... 367/174, 163, 173, 402

[56] References Cited

U.S. PATENT DOCUMENTS

| | | | |
|---|---|---|---|
| 2,947,969 | 8/1960 | Harris | 367/173 |
| 3,854,060 | 12/1974 | Cook | 310/326 |
| 3,858,165 | 12/1974 | Pegg | 367/173 |
| 3,990,035 | 11/1976 | Byers | 367/141 |
| 3,998,824 | 12/1976 | Otsuki et al. | 264/249 |
| 4,023,257 | 5/1977 | Wright et al. | 29/460 |
| 4,300,219 | 11/1981 | Joyal | 367/174 |
| 4,745,584 | 5/1988 | Andersen | 367/153 |
| 4,820,753 | 4/1989 | Caprette, Jr. et al. | 524/41 |
| 4,997,705 | 3/1991 | Caprette, Jr. et al. | 428/302 |
| 5,047,996 | 9/1991 | Armiger et al. | 367/154 |

*Primary Examiner*—Ian J. Lobo

*Attorney, Agent, or Firm*—Harvey Fendelman; Thomas Glenn Keough

[57] ABSTRACT

A cost-effective, producible improved apparatus for and method of fabricating a transducer acoustic window for a marine environment has acceptable acoustic energy transmitting properties and appropriate mechanical properties to withstand the rigors associated with varying velocities of flowing water, fluctuating temperatures, changing ambient pressures, the abuse attendant operations, etc., that are routinely encountered during a prolonged deployment. The acoustic window has a cast CONAP 1556 polyurethane window portion that extends over a hull opening and on a bearing surface rim about the opening. A number of equidistantly, circumferentially spaced stainless steel inserts are molded in the cast polyurethane window portion. Each of the inserts has a threaded outer surface, a machined flat, a longitudinal slot and a countersunk unthreaded bore and each threaded outer surface, machined flat and longitudinal slot mechanically engage the cast polyurethane window portion in an adhering and bonding relationship. A separate mounting bolt is inserted through each countersunk unthreaded bore and tightened in mating threads provided in the bearing surface rim. This secures the acoustic window portion on the hull with reduced stresses and strains and assures a strong, durable conforming structure while reducing the possibility of damage to the acoustic window portion.

3 Claims, 3 Drawing Sheets

ACOUSTIC WINDOW

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Over the years a considerable number of undersea transducer designs have evolved and, although their applications and configurations have varied, all seem to rely on some sort of an acoustic window that functions as a covering or separation that, at least, partially protects the transducer from the harsh marine environment. The acoustic window should be a cost-effective, producible design that is capable of acceptably transmitting acoustic energy while being rugged enough to withstand the rigors associated with varying velocities of flowing water, fluctuating temperatures, changing ambient pressures, the abuse attendant operations, etc., that are routinely encountered during a prolonged deployment.

One acoustic window design/method used a dacron fabric reinforced modified syntactic epoxy prepregnated material. The method of manufacture for the window design/method involves a costly pressure/autoclave process requiring a relatively long production time. There is some conjecture that the original acoustic window design is stiff and does not conform easily to the slight contour of the mounting plate form and is sometimes damaged during installation. The window material, near the outer perimeter was provided with twelve countersunk clearance holes for the mounting bolts to be inserted therethrough. When excess torque is applied to any of the mounting bolts, the adjacent window material can be over stressed which might compromise the acoustic properties or the mechanical integrity.

Thus, there is a continuing need in the state of the art to provide a cost effective acoustic window having acceptable acoustical and mechanical properties over a wide range of operational conditions.

SUMMARY OF THE INVENTION

The present invention is directed to providing an improved apparatus for and method of fabricating a transducer acoustic window for a marine environment that is a cost-effective, producible design capable of acceptably transmitting acoustic energy and having appropriate mechanical properties. The improved acoustic window for a transducer that is located near an opening in a ship's hull has a cast polyurethane window portion that is sized to cover the opening and extend to cover a bearing surface rim about the opening. A number of inserts are equidistantly, circumferentially spaced from one another and are molded in the cast polyurethane window portion. Each of the inserts is provided with a threaded outer surface, a machined flat, a longitudinal slot and a countersunk unthreaded bore and each threaded outer surface, machined flat and a longitudinal slot to mechanically engage the cast polyurethane window portion in an adhering and bonding relationship so that a number of mounting bolts each inserted through a separate countersunk unthreaded bore can be screwed into and tightened in correspondingly mating threads provided in the bearing surface rim about the opening to thereby secure the acoustic window portion on the hull to assure a strong, durable conforming structure while reducing the possibility of damage to the acoustic window portion. The method involves the casting of a CONAP 1556 material as the window portion to engage the threaded stainless steel inserts.

An object of the invention is to provide an improved method for making and apparatus of a marine acoustic window.

An object of the invention is to provide an improved method for making and apparatus of a marine acoustic window that provides for an improved mechanical integrity.

An object of the invention is to provide an improved method for making and apparatus of a marine acoustic window that provides for an improved mechanical integrity that is cost effective.

Another object is to provide an improved method for making and apparatus of a marine acoustic window that reduces the possibility of failure or the alteration of acoustic properties.

Another object is to provide an improved method for making and apparatus of a marine acoustic window that is quickly fabricated and is cost effective.

Another object is to provide an improved method for making and apparatus of a marine acoustic window that is more conforming to a structural curvature and less subject to damage when securing bolts are tightened.

These and other objects of the invention will become more readily apparent from the ensuing specification when taken in conjunction with the drawings and the appended claims.

DESCRIPTION OF THE PREFERRED EMBODIMENTS

Figure 1:
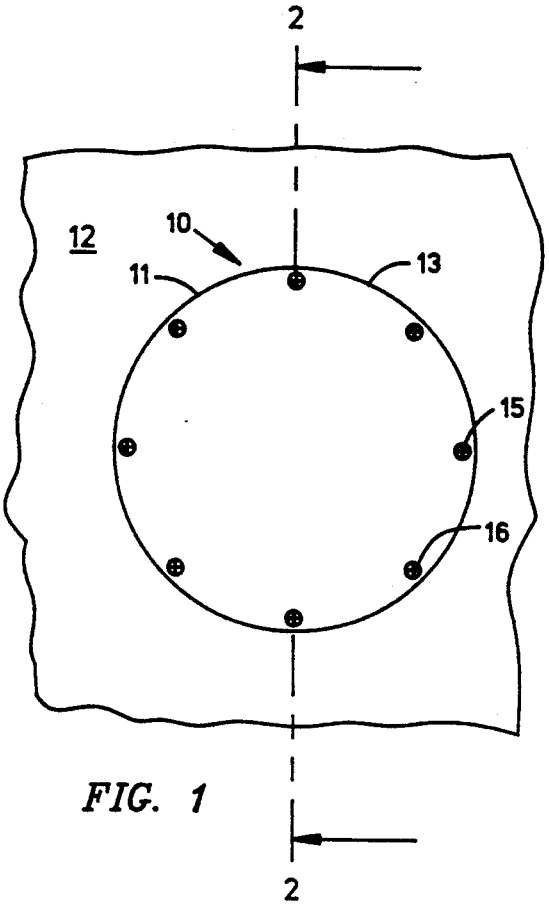
FIG. 1 depicts a front view of an acoustic window with eight inserts in accordance with this inventive concept mounted on a structural curvature of a ship, for example.
Figure 2:
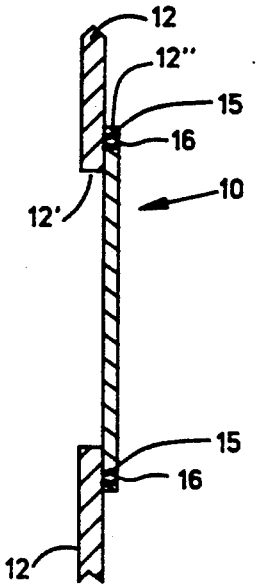
FIG. 2 shows a cross-sectional view of the acoustic window taken, generally along line 2—2 in FIG. 1.

Referring to FIGS. 1 and 2 of the drawings, an acoustic window 10 has a window portion 11 that is sized to cover an opening 12' in a submerged portion of a ship's hull 12 and may be shaped conform to the structural curvature of the hull. The acoustic window is intended to be located in fluid communication with the salt water medium and usually has both sides flooded to help create a communication path for an acoustic transducer 13 located near the opening in a submerged hull portion of the ship.

The window portion has an essentially flat disc-shaped configuration and is molded from an appropriate material. The material selected for the window portion has both the mechanical properties for a sufficient protection of the transducer and the acoustic properties for an acceptable acoustic transmission path. The material selected will be elaborated on below.

Figure 3:
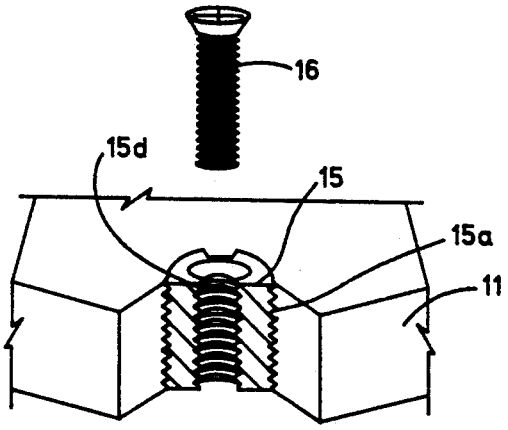
FIG. 3 is a partial cross section of a detail of the acoustic window of FIGS. 1 and 2.
Figure 4:
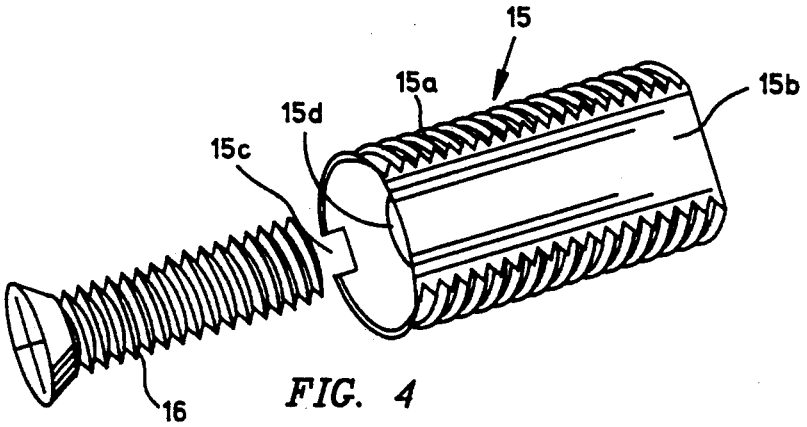
FIG. 4 elaborates on the insert of the detail of FIG. 3 that is included in accordance with this inventive concept.

The window portion is secured to the hull via a plurality of stainless steel inserts 15 that ar selected in design to assure a strong, durable conforming structure while reducing the possibility of damage to the window portion during mounting on the hull. The inserts can be made from other materials having the suitable properties of corrosion resistance, strength and machinability to allow each of the inserts to be machined appropriately with a threaded outer surface 15*a*, a machined flat 15*b*, a longitudinal slot 15*c* and a countersunk unthreaded bore 15*d*, see FIGS. 3 and 4.

The properly shaped inserts are molded into window portion 11 during fabrication and are equidistantly, circumferentially disposed about the window portion. Although the drawings depict eight equidistantly, circumferentially disposed inserts, it is apparent to one skilled in the art to which this invention pertains that the number and spacing of the circumferentially disposed inserts may vary to suitably accommodate differently sized windows or different ambient conditions as called for under different operational situations.

Each countersunk unthreaded bore 15*d* of each insert 15 is sized appropriately to receive a mounting bolt 16. The material of the bolt should be the same as the insert (stainless steel, for example) to avoid the problems associated with electrolysis. Hull 12 is provided with a plurality of threaded bores 12*a* that are sized to mate with mounting bolts 16 and are appropriately located to correspond to the spatial disposition of the countersunk bores in an about one inch bearing surface rim 12" about opening 12' that is intended to support the acoustic window. When countersunk unthreaded bores 15*d* and threaded bores 12*a* are aligned and threaded mounting bolts are fitted and tightened, the acoustic window can be secured to the hull on bearing surface rim 12". This mounting of the acoustic window is without the creation of failure inducing stresses and strains in the acoustic window-hull interface. Furthermore, the shape thereby presented by the acoustic window is only a slightly raised area on the hull that does not overly compromise the streamline shape of the ship's contour so that, as a consequence, turbulence and the problems associated with flow noise are reduced.

Figure 5:
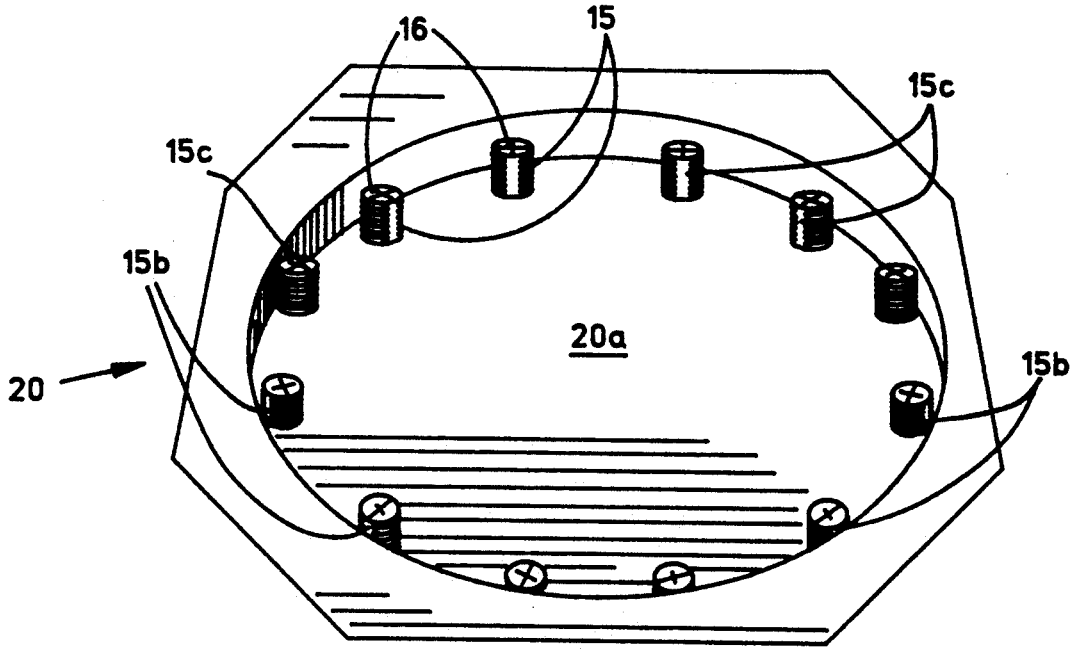
FIG. 5 schematically depicts a mold with twelve inserts in place used in the molding of an acoustic window.
Figure 6:
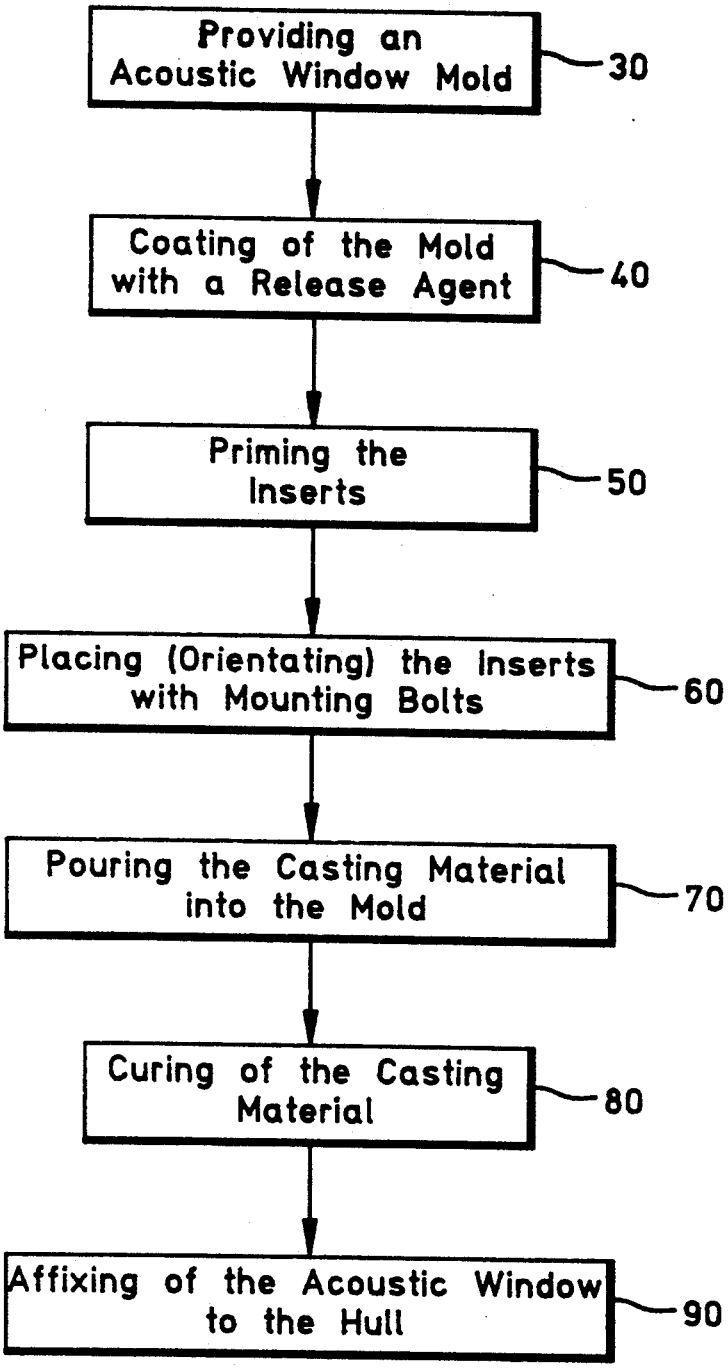
FIG. 6 illustrates the method of fabrication an acoustic window in accordance with this inventive concept

Referring to FIGS. 5 and 6, the method of construction an acoustic window in accordance with this inventive concept calls for the providing 30 of an acoustic window mold 20 that, first, is capable of holding the desired number of stress-dissipating stainless steel inserts 15 for the duration of the molding process and, second, has a molding cavity 20*a* of the proper size to yield the required cured diameter acoustic window. Molding cavity 20*a* of essentially dish-shaped mold 20 is properly dimensioned to create a molded window portion that covers the transducer opening of a hull and that has a correct thickness for acceptable acoustic properties. An appropriate number of threaded bores 20*b* are equidistantly, circumferentially located in mold 20.

The next step in the method of construction is the coating 40 of the mold with a release agent. Next a priming 50 and placing (orienting) 60 of inserts 15 with mounting bolts 16 holds the inserts in the proper place. Mounting bolts 16 are inserted through countersunk unthreaded bores 15*d* of stainless steel inserts 15 and threaded into threaded bores 20*b* to secure a stainless steel insert 15 in place. The inserts are oriented to locate each machined flat 15*b* facing radially outwardly toward the circumference of window portion 11 with their longitudinal slots 15*c* facing toward the center of the window portion to reduce the possibility of creating a weak spot at the circumference. The next step is the pouring 70 of a sufficient degassed polyurethane to provide the proper thickness, a curing 80 of the polyurethane casting material and the affixing 90 of the acoustic window on the hull about the opening to provide for a transducer acoustic window in a marine environment that is a cost-effective, producible design capable of acceptably transmitting acoustic energy and having appropriate mechanical properties to withstand the rigors associated with varying velocities of flowing water, fluctuating temperatures, changing ambient pressures, the abuse attendant operations, etc., that are routinely encountered during a prolonged deployment. One of the unique features of this design is that the stainless steel inserts distribute the load evenly, allowing a lower strength material with acoustically acceptable properties to be used.

To elaborate on the method set forth above, the selected polyurethane is first mixed according to the manufacturer's instructions. Preparing the polyurethane generally requires about 2 hours. While the polyurethane is being prepared, the following steps can be accomplished, acoustic window mold 20 with an appropriate commercially available mold-release material. Next, inserts 15 are thoroughly cleaned with a suitable commercially available solvent and coated with a suitable primer to help assure that the polyurethane adheres to and is bonded onto the inserts during the preparation of the polyurethane. Mounting bolts 16 or other securing means are inserted into the inserts to secure them in their proper equidistantly, circumferentially spaced position in the mold.

The acoustic window mold with the inserts is placed into a drying oven and preheated. Meanwhile, the polyurethane molding compound is thoroughly mixed and initially degassed and is poured into the mold. At this point, the acoustic window mold should be placed in a vacuum chamber to further evacuate any remaining bubbles. The bubble-free molding compound filling the mold is removed from the vacuum chamber and placed on a level surface to cool overnight at room temperature. Next, the filled mold is placed in a drying oven for 16 hours at 180° F. and then is removed from the oven and allowed to slowly cool to room temperature.

When cool, the acoustic window is removed from the acoustic window mold and inspected both visually and mechanically. The circular edge of the window is beveled with sandpaper, the tops of the inserts are cleaned of any material that may be present, and any remaining mold release on the acoustic window is removed with solvent.

A material that has been discovered to possess the appropriate mechanical properties and acoustically acceptable properties is the polyurethane resin system commercially marketed under the trademark CONATHANE TM EN-1556 by CONAP Inc., 1405 Buffalo Street, Olean, N.Y. 14760-1139. This material, hereinafter referred to as CONAP 1556, when molded in accordance with the manufacture's specifications is a tough, cold-flow resistant elastomer that has good resistance to sea water, among other things. CONAP 1556 has other acceptable mechanical properties for this inventive concept including tensile strength, static load test, etc., while providing acceptable acoustic performance. CONAP 1556, exceeds other tested window materials. The characteristic impedance, pc, is $1.65\times10^6$ Ryle, which is a much closer match to seawater ($1.54\times10^6$). The tensile strength of CONAP 1556is 5,000 psi and it provides a safety factor of 1.67.

Figure 7:
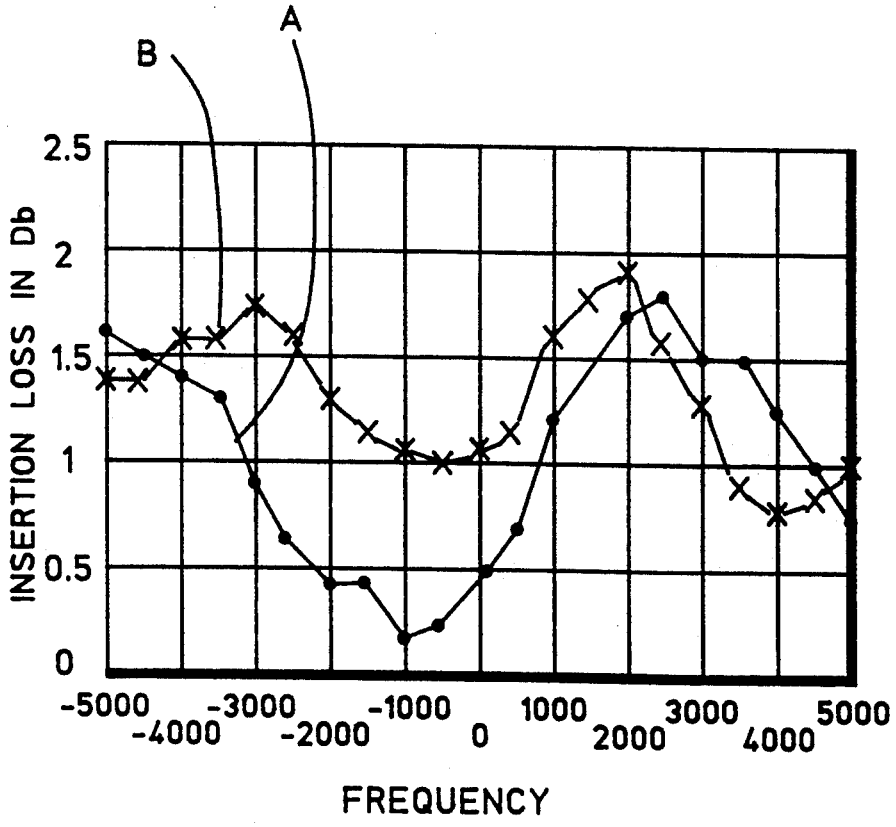
FIG. 7 shows a comparison of the insertion loss associated with a three quarter inch thick thirteen inch diameter acoustic window fabricated from CONAP 1556 polyurethane (line A) with respect to a similarly configured other polyurethane molding material (line B).

An acoustic window fabricated in accordance with this inventive concept using the CONAP 1556 polyurethane is also cost effective and producible. The plate is flat, of uniform thickness, and the material is homogenous and isotropic and has a thickness of about 0.750−0.000/−0.020 inch with an outside diameter of about 12.88−0.00/−0.06 inches. The mature production cost of the acoustic window of this inventive concept is less than $750 as compared to the $3100 $1800cost of the version referred to in the background supra. The acoustic window of this inventive concept has a quick manufacturing response, (i.e., a complete acoustic window tailored for a ship can be fabricated in 3 days as compared to the months it takes with the conventional design referred to in the background supra. An acoustic window fabricated in accordance with this inventive concept using the CONAP 1556polyurethane is more conforming to the structure curvature and is less subject to damage when the bolts might be over torqued so that its mechanical and acoustic properties are not compromised, see FIG. 7 that depicts the improved insertion loss that is associated with a three quarter inch thick thirteen inch diameter acoustic window fabricated from CONAP 1556polyurethane (line A) as compared to another polyurethane molding material (line B).

Obviously, many modifications and variations of the present invention are possible in the light of the above teachings. It is therefore to be understood that within the scope of the appended claims, the invention may be practiced otherwise than as specifically described.

I claim:

1. An improved acoustic window for a transducer located near an opening in a hull comprising:

a cast polyurethane window portion sized to cover said opening and extended to cover a bearing surface rim about said opening on said hull;

a plurality of inserts equidistantly, circumferentially spaced from one another and molded in said cast polyurethane window portion, each of said inserts is provided with a threaded outer surface, a machined flat, a longitudinal slot and a countersunk unthreaded bore, each said threaded outer surface, said machined flat and said longitudinal slot engage said cast polyurethane window portion in an adhering and bonding relationship; and a plurality of mounting bolts each inserted through a separate said countersunk unthreaded bore to be screwed into and tightened in correspondingly mating threads provided in said bearing surface rim about said opening on said hull to thereby secure said acoustic window portion on said hull to assure a strong, durable conforming structure while reducing the possibility of damage to said acoustic window portion.

2. An improved acoustic window according to claim 1 in which said polyurethane window portion is fabricated from a material having both the properties for a sufficient protection of the transducer and the properties for an acceptable acoustic transmission path and said inserts are made from materials having the properties of corrosion resistance, strength and machinability.

3. An improved acoustic window according to claim 1 in which said cast polyurethane window portion is a homogenous and isotropic polyurethane resin system and said inserts are stainless steel.

* * * * *